United States Patent [19]

Ushikoshi

[11] 4,436,435

[45] Mar. 13, 1984

[54] ANALOG AND DIGITAL DISPLAY TIMEPIECE

[75] Inventor: Kenichi Ushikoshi, Suwa, Japan

[73] Assignee: Kabushiki Kaisha Suwa Seikosha, Tokyo, Japan

[21] Appl. No.: 430,426

[22] Filed: Sep. 30, 1982

Related U.S. Application Data

[63] Continuation of Ser. No. 147,881, May 8, 1980, abandoned.

[30] Foreign Application Priority Data

May 8, 1979 [JP] Japan ..... 54-61172
Oct. 11, 1979 [JP] Japan ..... 54-131001

[51] Int. Cl.[3] ..... G04B 25/00
[52] U.S. Cl. ..... 368/71; 368/223; 368/242; 368/239
[58] Field of Search ..... 368/76, 71, 80, 82–84, 368/223, 239–242, 228, 281, 330, 331 R; 350/332, 338

[56] References Cited

U.S. PATENT DOCUMENTS

| | | | |
|---|---|---|---|
| 3,945,191 | 3/1976 | Van Berkum | 368/29 |
| 4,077,032 | 2/1978 | Volkmann | 368/29 |
| 4,218,872 | 8/1980 | Ikegami | 368/82 |
| 4,250,572 | 2/1981 | Yoshida | 368/242 |
| 4,257,115 | 3/1981 | Hatuse et al. | 368/80 X |
| 4,262,345 | 4/1981 | Gawter et al. | 368/76 X |
| 4,264,970 | 4/1981 | Nishimura et al. | 368/84 X |

*Primary Examiner*—Bernard Roskoski
*Attorney, Agent, or Firm*—Blum, Kaplan, Friedman, Silberman and Beran

[57] ABSTRACT

A timepiece including an analog display of time and a digital display of time is provided. The analog display includes at least an hour hand and a minute hand with the digital display disposed within the region between the analog dial and the cover glass in a region adjacent to the analog display. In another embodiment of the invention, the digital display of the electro-optical type is inclined at an angle between about 5° and 30° with respect to the analog display dial.

13 Claims, 18 Drawing Figures

FIG. 1
PRIOR ART
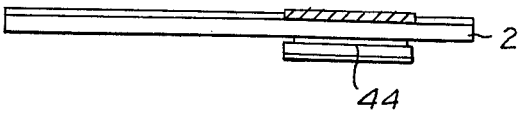
FIG. 3
PRIOR ART
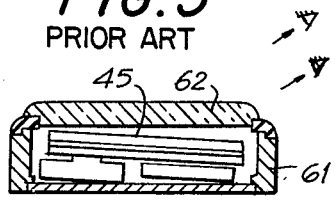
FIG. 2
PRIOR ART
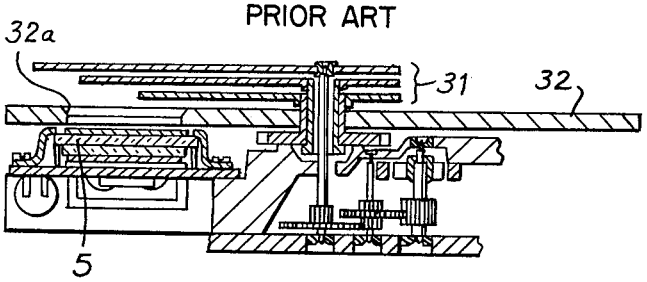
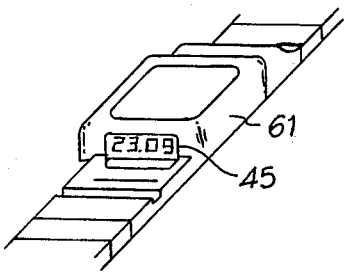
FIG. 4
PRIOR ART

ANALOG AND DIGITAL DISPLAY TIMEPIECE

This is a continuation, of application Ser. No. 147,881, filed May 8, 1980, now abandoned.

BACKGROUND OF THE INVENTION

This invention relates generally to an electronic timepiece and, more particularly, to a wristwatch including an analog display and an electro-optical digital display.

It has been proposed in Japanese laid-open patent publication No. 51-117,667 to provide a hybrid display watch including both an analog display with an hour, minute and second hand and a digital display having various functions, such as date and day displays and the chronograph function. The digital display is based on a liquid crystal display. Japanese laid-open patent publication No. 53-126,674 proposes a hybrid watch wherein the digital display is a liquid crystal layer utilizing a glass dial as the upper panel. Alternatively, an analog dial is formed with an aperture for reading a digital display placed within the wristwatch movement.

In Japanese laid-open patent publication No. 53-65,764 and No. 51-50,070 it has been proposed to incline the digital display panel. Each of these prior suggested constructions has been less than completely satisfactory.

When the digital display is formed as part of the analog display dial, as illustrated in FIG. 1, the upper surface of the dial cannot be plated in the usual manner. This limits the degree of freedom for finishing the upper surface and tends to restrict the size of the analog display causing the digital display to be prominent with the analog display secondary. When the digital display is placed beneath the dial, as shown in FIG. 2, it is difficult to obtain a clear view of the digital display. In the construction illustrated in FIG. 3 the digital display is merely inclined with respect to the watch case preventing construction of a thin and small wristwatch. In the construction shown in FIG. 3, the digital display is arranged in the region outside the analog display on the case band. This substantially increases costs in finishing the case band.

Accordingly, it would be desireable to provide a hybrid wristwatch including both an analog display and a digital display which generates a true integrated feeling of the two displays and overcomes the disadvantages of these prior art constructions.

SUMMARY OF THE INVENTION

Generally speaking, in accordance with the invention, a hybrid-type electronic wristwatch is provided. The wristwatch includes an analog display of time, including at least an hour and minute hand, and a digital display of time within a watch case. The digital display is disposed within the region between the cover glass and analog display dial on the same plane as the analog display. The digital display utilizes the space occupied by the hand set of the analog display and may utilize the dial as a reflector in a liquid crystal digital display.

In another embodiment of the invention, the electro-optical digital display is inclined at an angle between about 5° and 30° with respect to the plane of the dial of the analog display. An inclined digital display is disposed in the 12:00 o'clock region of the analog display dial and the hands may overlap a portion of the inclined display for providing a compact and unified construction.

Accordingly, it is an object of the invention to provide an improved hybrid display timepiece.

Another object of the invention is to provide an improved wristwatch having an analog display and a digital display.

A further object of the invention is to provide an improved wristwatch including an analog display having at least an hour hand and a minute hand and a liquid crystal digital display utilizing the analog dial as a reflector.

Still another object of the invention is to provide an improved wristwatch having an analog display and a digital display, with the digital display disposed in the region between the analog display dial and the cover glass.

Another object of the invention is to provide an improved hybrid-type timepiece, wherein the digital display is inclined at an angle between about 5° and 30° with respect to the dial of the analog display.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a cross-sectional view of a portion of a glass plate watch dial;

FIG. 2 is a partial cross-sectional view of a hybrid-type wristwatch with the digital display disposed beneath the analog display dial;

FIG. 3 is a cross-sectional view showing an inclined display device;

FIG. 4 is a perspective view of a hybrid-type wristwatch having the digital display on the watch band;

FIG. 9(*b*) is a cross-sectional view of another connector;

FIG. 9(*c*) is a further cross-sectional view of yet another connector;

DESCRIPTION OF THE PREFERRED EMBODIMENTS

Figure 5:
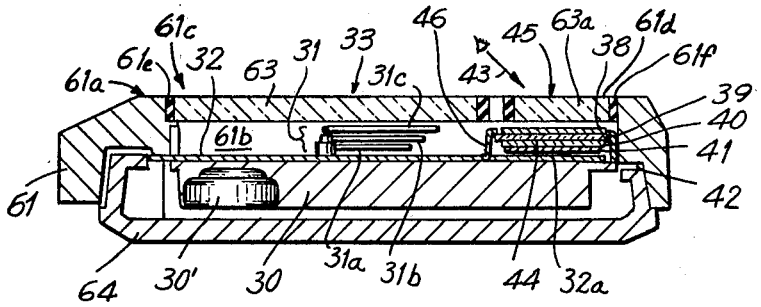
FIG. 5 is a cross-sectional view of a hybrid-type wristwatch constructed and arranged in accordance with a first embodiment of the invention.

Referring now to FIG. 1, a cross-sectional view of the proposal in Japanese laid-open patent specification No. 53-126,674 is shown. In this construction, a liquid crystal cell 44 for providing a digital display is formed utilizing a glass plate dial 2. In FIG. 2, the hybrid-type watch includes an analog display with hands 31 and an analog dial 32. Dial 32 is formed with an opening 32*a* for viewing a liquid crystal display 5 disposed beneath dial 32 in registration with opening 32*a*. These constructions suffer from the shortcomings noted above.

In FIGS. 3 and 4 a digital display panel 45 is shown inclined with respect to a watch case 61. In FIG. 3, display panel 45 is merely inclined with respect to case 61 so that the space formed between panel 45 and the cover glass 62 is not useful when a thin and small watch is desired. On the other hand, in FIG. 4 display panel 45 is arranged in the case band of watch case 61 at 6:00 o'clock position of the watch. This construction presents serious disadvantages as watch case 61 must be machined to receive display panel 45 which is a serious disadvantage.

Figure 6:
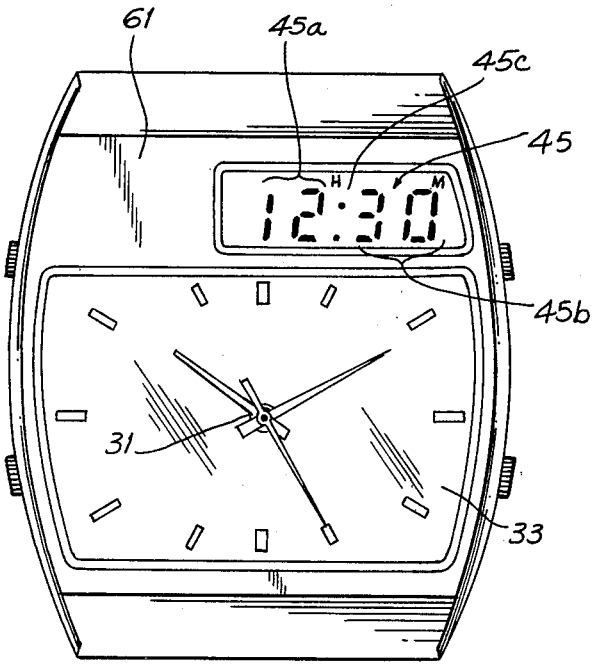
FIG. 6 is a plan view of the wristwatch construction illustrated in FIG. 5.

Referring now to FIGS. 5 and 6, a hybrid-type wristwatch including an analog display of time and a digital display of time constructed and arranged in accordance with the invention which overcomes these disadvantages is shown. The wristwatch includes a watch case 61 having an upper display surface 61*a* and an interior 61*b* for receiving a watch movement 30. Watch case 61 is formed with a first analog display opening 61*c* for viewing analog display 33 and a second digital display opening 61*d* adjacent thereto for viewing a digital display 45. A first cover glass 63 is compressively retained within first opening 61*e* and a second cover glass 63*a* is compressively retained within second opening 61*d* by a pair of gaskets 63*e* and 63*f*, respectively.

Analog display 33 includes analog display drive means (not shown) in watch movement 30 for driving a hand unit 31 which in the embodiment illustrated includes an hour hand 31*a*, a minute hand 31*b* and a second hand 31*c*. Hand unit 31 is utilized in conjunction with a conventional metal dial 32. The surface of metal dial 32 can be finished in a variety of manners and can be provided in different colors or can be plated glass.

When digital display 45 is a liquid crystal display device as illustrated in FIG. 5, the display includes an upper polarizer 38, a lower polarizer 41 disposed about an upper panel glass 39 and a lower panel glass 40. A liquid crystal layer 44 is disposed in the region between upper panel 39 and lower panel 40. Transparent electrode means are disposed on the interior surfaces of upper and lower panel 39 and 40 and a connector 42 is disposed between the electrode means and watch movement 30 for providing electrical connection between the circuits (not shown) enclosed within watch movement 30 and the electrodes on the interior surfaces of upper and lower panels 39 and 40. Watch dial 32 of analog display 33 extends from the analog display to a region 32*a* below liquid crystal display 45 and is utilized as a reflector beneath lower polarizer 41. Thus, all the panel elements usually included in a liquid crystal display device are provided, the liquid crystal display panel being retained in position by a retaining clip 46.

As is well known in the art, a line of view 43 from outside liquid crystal display device 45 passes through upper and lower polarizers 38 and 41, respectively. Both the lower surface of upper panel 30 and the upper surface of lower panel 40 are provided with transparent electrodes. Liquid crystal layer 44 sealed between these electrodes is optically active and rotates a plan of polarized light entering the device if liquid crystal layer 44 is of a twisted nematic type. When the axis of polarization of the polarizers are perpendicular, and the required threshold voltage is applied between opposed electrodes, the region becomes visually distinguishable from the remaining portion of the display device. This is due to the fact that the optical activity is lost in this region and the polarized light does not reach the reflector region of watch dial 32 causing this region to appear black. The electrodes are commonly arranged in a seven bar display for displaying alpha-numeric characters. The light which enters the other regions of the display is returned towards the eye of the viewer along of view 43 by the reflector region 32*a* of watch dial 32. Desired symbols and characters can be displayed selectively from signals from the electronic watch circuit in watch movement 30.

In the embodiment illustrated in FIG. 5, the wristwatch also includes a case back 64 which cooperates with watch case 61 for enclosing interior region 61*b* of the wristwatch. A battery 30′ retained within a region of watch movement 30 for providing power for operating the watch circuits contained in movement 30 and for driving the displays.

Referring now to FIG. 6, a plan view of display surface 61*a* of the wristwatch illustrated in FIG. 5 is shown. Hand unit 31 of analog display 33 is shown adjacent to digital display 45 in non-overlapping arrangement. In the embodiment illustrated, digital display 45 includes an hour display 45*a* and a minute 45*b* with a colon 45*c* disposed therebetween. Generally speaking, colon 45*c* is made to flicker each second during display of actual time.

Generally speaking, in the prior art constructions wherein the analog display was relatively large with respect to the digital display, digital display panel 5 was usually located within the watch movement as illustrated in FIG. 2. In contrast, in a construction in accordance with the invention, the hand space, namely the region between watch dial 32 and cover glass 62 is effectively used for positioning the digital display 45. Hand unit 31 and digital display 45 are arranged in almost the same plane. In this case, it is unnecessary to provide space for housing the digital display within the movement of the analog display. In view of this, the overall wristwatch can be made much thinner.

Positioning liquid crystal panel 45 near cover glass 63*a* enables even the smallest characters displayed on the digital display to be read clearly. As noted above, a portion of watch dial 32 may be utilized as a reflector for digital display 45. When this is done, the number of constituent elements in the wristwatch is reduced, further assisting in reduction in thickness of the watch. This also permits reflector region 32*a* of digital display 45 and watch dial 32 to be finished in the same manner. For example, if oblique lines are provided across watch dial 32, the liquid crystal display 45 would provide the same background design behind displayed characters in digital display 45 as the background in analog display 33. Accordingly, an advantage of uniformity and true integration of the hybrid-type displays is provided.

In a specific embodiment constructed and arranged in accordance with the invention, the hand space between the lower surface of cover glass 63 and the upper surface of watch dial 32 is generally in the range of from about 0.9 to 1.3 mm. The thickness of one of the polarizers 38 and 41 is about 0.15 mm and that of transparent terminals 39 and 40 is about 0.4 mm. A liquid crystal reflector panel is generally between 0.2 and 0.3 mm in thickness. Thus, without the reflector the thickness of display panel 45 is about 1.1 mm in thickness. In the case that the thickness of the liquid crystal display panel does not correspond to that of the hand space of a particular watch, watch dial 32 may be provided with a recess in the region where the liquid crystal panel is to be positioned or another member may be provided on the watch dial.

As noted above above, by constructing and arranging a hybrid-type wristwatch in accordance with the invention, a thin wristwatch having the uniformity and external appearance may be provided. The wristwatch includes a digital display arranged in the hand space of the analog display in the hybrid-type wristwatch.

Figure 7:
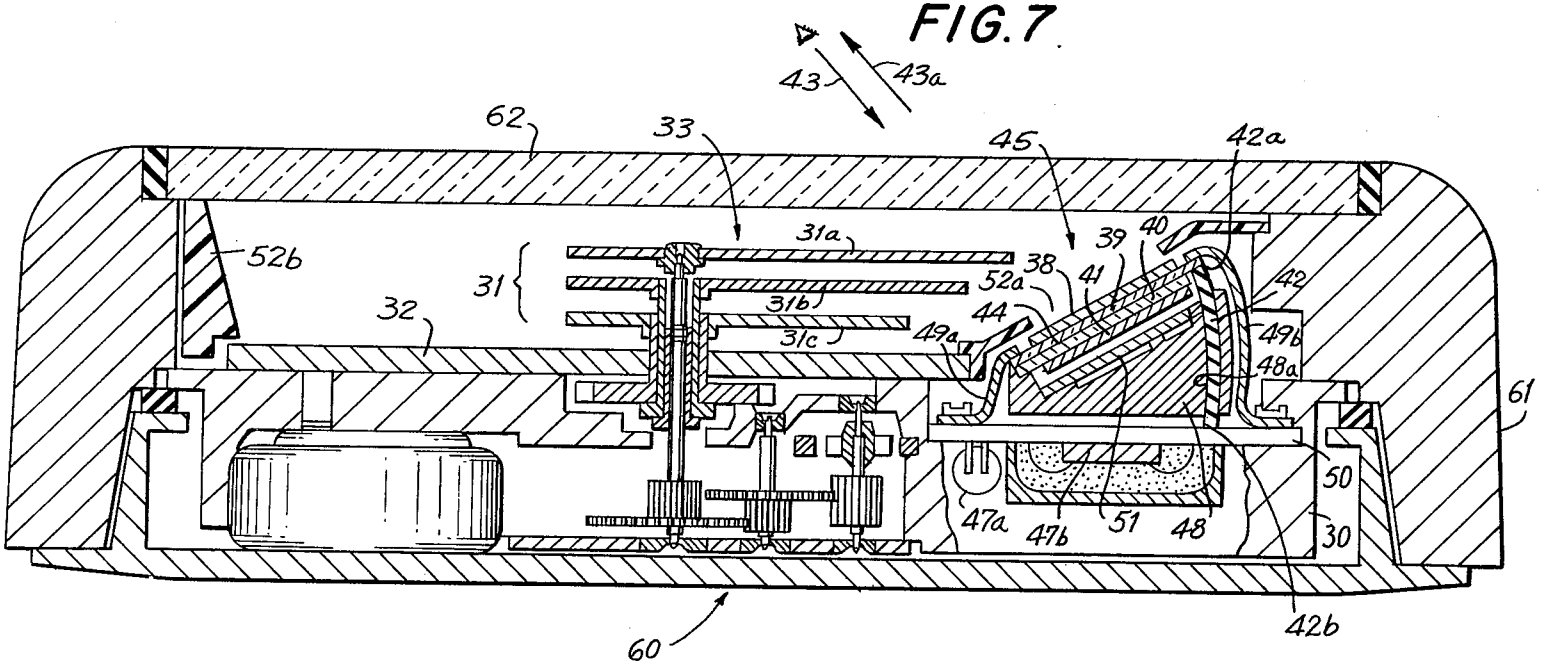
FIG. 7 is a cross-sectional view of a hybrid-type wristwatch constructed and arranged in accordance with a second embodiment of the invention.
Figure 8:
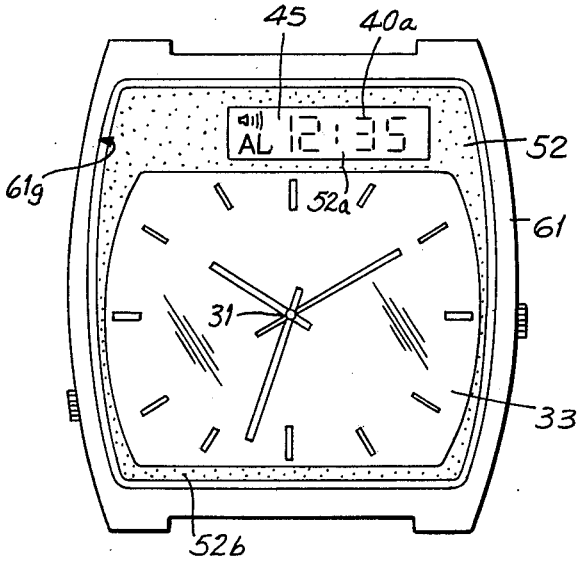
FIG. 8 is a plan view of the wristwatch illustrated in FIG. 7.

Referring now to FIGS. 7 and 8, a hybrid-type electronic wristwatch, constructed and arranged in accordance with a further embodiment of the invention is shown. Specifically, the construction illustrated in accordance with this embodiment provides a hybrid-type wristwatch wherein the analog display is the principal display of the wristwatch.

The electronic wristwatch includes a quartz crystal oscillator **47*a* mounted to a circuit substrate 50 for providing a time standard. The wristwatach electronic circuit includes a decoder circuit for controlling the oscillations and frequency divisions of quartz crystal oscillator 47*a* and the drive current applied to a motor and for driving the electro-optical display. The electronic circuit includes an IC chip 47*b* having an integrated circuit and a motor and gear train 60, which are rotated in response to the signal generated by IC chip 47*b***.

Hand unit 31 is driven rotationaly by motor and gear train 30 for indicating time. As is the case with the embodiment illustrated in FIG. 5, this embodiment includes hour hand **31*a*, minute hand 31*b* and second hand 31*c*. Hand unit 31 and watch dial 32 constitute the analog display 33 of the hybrid-type wristwatch illustrated in FIGS. 7 and 8**.

Thus, a wristwatch constructed and arranged in accordance with the invention described to this point is identical to the conventional analog quartz wristwatch, except for the construction of IC chip **47*b*** which will be varied for the electrical-optical display described below. An electrochromic display can be utilized for the digital display. However, the detailed description provided above and in connection with this embodiment will be directed toward the well-known liquid crystal display panels.

Digital display 45 is disposed within watch case 61 at an angle with respect to analog display 33. The constituent elements of digital display 45 are the same as those in a conventional display as described in connection with the display in FIG. 5. Accordingly, like reference numerals are utilized to describe like elements. With respect to the inclination of display 45, opposed parallel panels 39 and 40 are sandwiched between upper polarizer 38 and lower polarizer 41. Each of these planar elements is disposed at an angle to analog display 32. Digital display 45 is positioned within watch case 61 in the 12:00 o'clock region of analog display 33.

Digital display 45 includes transparent electrode means disposed on the inner surfaces of upper and lower panel 39 and 40. Reflector 51 for display 45 is disposed on a connector guide 48 which also acts as a guiding member for a connector 42 for providing electrical connection between the transparent electrodes and a circuit substrate 50. The panel holder 49 having a pair of cooperative elements **49*a* and 49*b* engage the upper surface of upper panel 59 for securing display 45 in position. Additionally, the engagement between panel holder and display 45 insures contact between connector 42 and circuit substrate 50**.

Digital display 45 also includes a parting plate frame member 52 which is disposed over at least a portion of analog dial 32. Parting plate 52 is included in order to cover the periphery of liquid crystal display 45 to keep out of field of view 43 the outer regions of display 45. By extending over the periphery of display 45 the functional and unattractive outer regions of the display are not seen when the watch is viewed in plan view as illustrated in FIG. 8.

Referring also to FIG. 8, watch case 61, in this embodiment of the invention is formed with a single display opening **61*g* on the display surface thereof. Parting plate 52 is retained beneath cover glass 62 and extends about analog display 53 as well as digital display 45. Parting plate 52 is formed with a digital display opening 52*a* for viewing digital display and a second analog opening 52*b* for viewing hand unit 31 of analog display 33. In this embodiment of the invention digital display 45 includes hour display 45*a*, minute display 45*b* and colon display 45*c* as in the embodiment illustrated in FIG. 6. In addition, display 45 may include an indication 45*d* of an alarm set and display the alarm time in display 45 while displaying actual time in analog display 33. Dial 32 include conventional analog time indicia 32*b*** and may be finished in a variety of manners.

Figure 10:
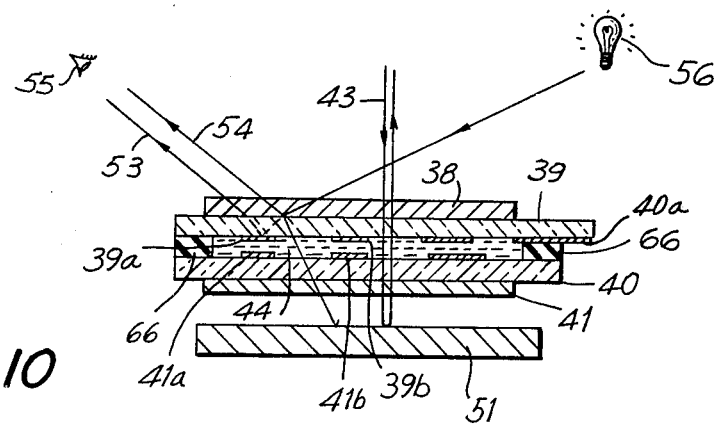
FIG. 10 is a cross-sectional view of a liquid crystal display device illustrating total reflection at the panel electrodes.

Turning now to FIGS. 7 and 10, the inclination of liquid crystal panel 45 with respect to the plan formed by analog dial 32 will be discussed. In a liquid crystal display, it is well known in the art that light traveling along a line of view **43*a* enters a liquid crystal cell through upper polarizer 38, upper panel 39, liquid crystal material 44, lower panel 40 and leaves the cell through lower panel 41. The light is then reflected by reflector 51 passes upwardly through the cell along line 43*a*** to the viewer passing through each element in reverse order.

The axes of polarization of upper polarizer 38 and lower polarizer 41 are usually disposed perpendicularly to each other. In this case, if liquid crystal material 44 is of the twisted nematic type a plane of polarized light passing through upper polarizer 38 is rotated 90° so that it passes through lower polarizer 41 and is reflected by reflector 51. As noted above, the interior surfaces of upper panel 39 and lower panel 40 have electrodes **39*a* and 40*a* disposed thereon for forming characters in the digital dislay. In the embodiment illustrated in FIG. 8, the display is of the conventional seven bar segmented display for forming characters in the time display 45*a*, 45*b* and 45*c* and an alarm indicator 45*d***.

In order to display one of these segments, a voltage above the threshold voltage for the display cell is applied across opposed electrode sgements. When liquid crystal material 44 is of the twisted nematic type, the optical activity of the liquid crystal material in the region between electrodes wherein the voltage is lost and no longer rotates the plane of polarized light entering the display cell. In this case, the plan of polarized light entering through upper polarizer 38 and upper panel 39 does not pass through lower polarizer 41 thereby rendering the region black and visually distinguishable from the remainder of the display panel. The remaining light not in the region of the applied voltage passes through the cell and is reflected by reflector 51 and returned along line 43*a* to the viewer. As a result of this, desired symbols and letters can be displayed by applying appropriate voltages to the electrodes in response to signals generated by IC chip 47*b* which includes the electronic watch circuit and driving circuits for the display in the usual manner.

When the liquid crystal display cell of FIG. 10 is viewed at a greater angle of inclination as indicated by eye 55, electrode segment 39*a* formed on the lower surface of panel 39 totally reflects the image of the light source indicated at 56. This occurs at a viewing angle at a greater inclination that a preset angle in accordance with the invention as will be described below. When this occurs the region of panel 39 free of electrode segments does not cause reflection in the line of view 54. Thus, even when an electrode segment is deenergized reflection occurs along line 53 thereby reducing the ability of a viewer to distinguish an energized segment. This results in an unclear display which is difficult to read. This unreadability increases undesirably if the size of the digital panel is reduced. This problem is overcome in accordance with this embodiment of the invention as follows.

Analog display 33 which includes a display of time by rotation of hand unit 31 and dial 32 usually extends in a plane parallel to cover glass 62. Circuit substrate 50 also lies in a plane parallel to analog dial 32. As noted above, digital display 45 is provided at an angle with respect to the plane of analog dial 32 and accordingly special provision is made for making the electrical connection between the electrodes disposed on the inner surface of glass panels 39 and 40 and circuit substrate 50.

The liquid crystal display cell, as noted above, is disposed on a guide member 48 by connectors 49*a* and 49*b*. Guide member 48 is formed with a guide opening 48*a* for receiving connector 42 which makes an electrical connection with circuit substrate 50 by a lower electrical connecting surface 42*b* and contacts the liquid crystal cell at a terminal region 40*a* formed by an upper electrical connecting surface 42*a*. This provides the electrical connection between IC circuit element which is connected to circuit substrate 50 and liquid crystal cell through the transparent electrode disposed on the inner surfaces of panel 39 and 40.

Connector guide member 48 is formed from an injection molded polymeric material and is molded with an inclined opening 48*a* for receiving connector 42. This permits electrical connection between the liquid crystal cell through connector 42 when the cell is secured by panel holders 49*a* and 49*b*.

Figure 9A:
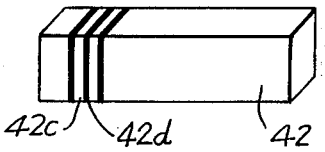
FIG. 9(*a*) is a perspective view of a connector utilized in the digital display region of the wristwatch of FIGS. 7 and 8.
Figure 9B:
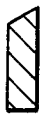
Figure 9C:
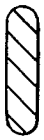

Referring now to FIG. 9(*a*) the construction of electrical connectors is shown. In the figure, conducting portion 42*c* and insulating portions 42*d* are alternating laminated in a guide member 49. A connector 42 having a rectangular cross-section can be utilized when the angle of inclination of the cell is at a small angle, namely 10° to 20°. However, when upper panel 39 is inclined at a greater angle with respect to circuit substrate 50 it is advantageous if connector 42 has a cross-section as illustrated in FIGS. 9(*b*) and 9(*c*). These latter instructions readily adjust to the inclination of the display panel. Moreover, conventional flexible tape can be utilized as the connector.

Referring now to FIG. 10, liquid crystal material 44 is shown disposed between upper panel 39 and lower panel 40. A seal 66 is thus required about the periphery of the display panel. In order to maintain sufficient contact between panels 39 and 40 and seal 66 and to provide an electrode terminal region for contact region 42*a* the liquid crystal dislay cell has a considerably larger planar area than that required for the display region having electrodes 39*a* and 41*a* disposed on the surfaces of panels 39 and 40. Accordingly, it is desirable that the outer peripheral regions of seal 66 and panels 39 and 40 not be readily viewable. As noted above, a parting plate 52 having opening 52*a* for viewing the display panel is provided. In the embodiment illustrated in FIGS. 7 and 8, parting plate 52 is formed with a first digital display opening 52*a* in registration with the display portion of the liquid crystal display cell and a second analog display opening 52*b* for viewing analog display 33. Parting plate member 52 can be formed from a polymeric material by various processing techniques. Alternatively, when formed of a metallic metallic material, parting plate member 52 may be formed by a drawing process or a by an electric casting process.

The angle of inclination of liquid crystal cell of digital display 45 with respect to analog display dial 32 will no be described in detail. In order that the panel be viewed at an appropriate angle of inclination, the size and elevation with respect to dial 32 are extremely important. The first case to be discussed is where the angle of inclination is the greatest and the second wherein the inclination of the panel is at a minimum.

Referring specifically to the liquid crystal display 45 in FIG. 7, the size of the character formed from segmented electrodes which can be distinguished visually is about 1.5 mm at the smallest. Upper panel 39 must then be about 2.5 to 3 mm in length taking into consideration seal 66 at the upper region and lower region of the display as well as an electrode terminal region for contacting region 42*a* of connector 42. The height of liquid crystal display 45 above dial 32 is limited to that of the distance required for analog hands 31. If the distance is any greater, liquid crystal display panel 45 would extend below dial 32. On the other hand, if cover glass 62 is raised, the height of the panel can be increased, but this imparts an unnecessary spacing between the hands and cover glass resulting in a thicker watch than desired.

The distance between cover glass 62 and the surface of watch dial 32 is generally about 1 to 1.5 mm. Accordingly, the maximum inclination of liquid crystal display panel 45 can be determined by the following expression:

$$\sin^{-1}\frac{1 \text{ to } 1.5}{2.5 \text{ to } 3} \approx 25 \text{ to } 30 \text{ degrees}$$

Figure 12:
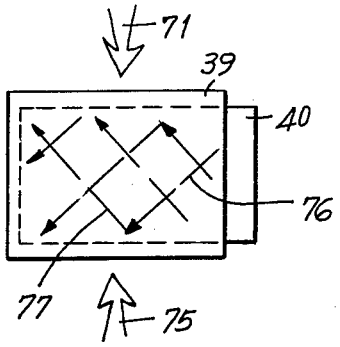
FIG. 12 is a plan view of the angles of viewing a liquid crystal display device.
Figure 13:
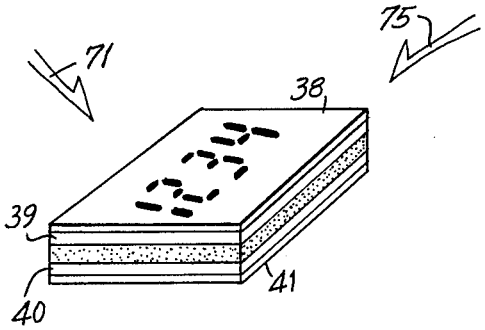
FIG. 13 is a perspective view of the viewing angles of a liquid crystal display device.

As noted above, when a twisted nematic liquid crystal (the "TN" type) is used in the display cell, the contrast of the display is highly dependent upon the angle of viewing the cell. According to the Japanese Patent Publication No. 53-6857, and as shown in FIGS. 12 and 13, the display is clear when viewed from direction 75 or the 6:00 o'clock direction and not clear when viewed from the direction 71 or 12:00 o'clock side of the watch.

When viewed from direction 71, the optical inactivity in the liquid crystal material disposed between the electrodes across which a minimum threshold voltage has been applied does not appear. In contrast, when viewed from direction 75, the optical inactivity caused by the voltage supplied across the opposed electrode renders the regions clearly visually distinguishable from the remainder of the panel. It is pointed out in this Patent Publication that the rubbing directions of the glass panels in contact with the liquid crystal material are wall azimuthes 76 and 77 and have 75 as the direction of clear view. Specifically, the regions where there is sufficient contrast between the dark regions of the display where the electrodes are supplied with the threshold voltage and the brightness of the surrounding regions is arranged within which this optically inactive effect appears in accordance with the line of viewing the panel. The direction in which this region of clear vision is called the direction of clear vision.

Figure 14:
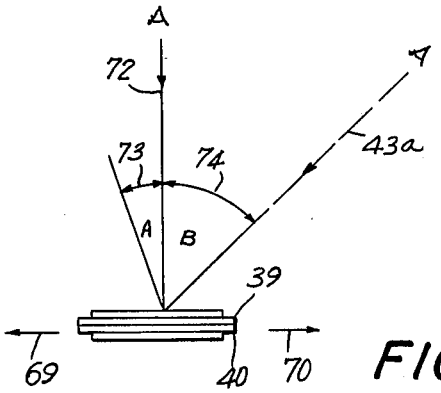
FIG. 14–16 are illustrative views of liquid crystal display panel inclinations and direction of clear vision.
Figure 15:
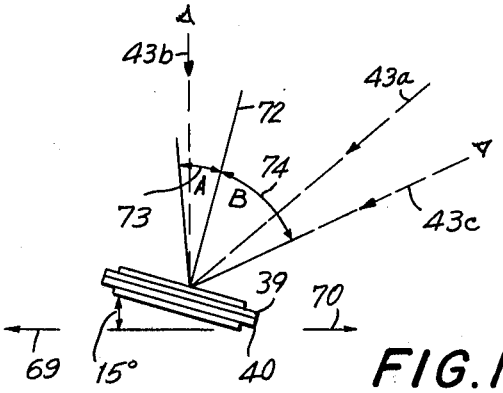
Figure 16:
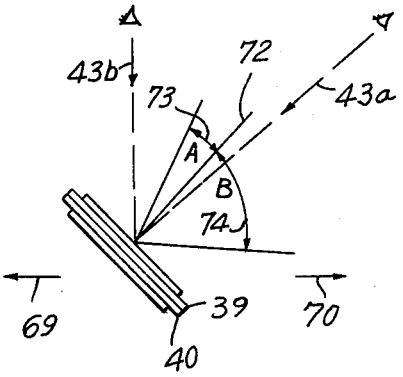

Referring now to FIGS. 14–16, the cross-section of a display panel through the line extending between the 12:00 o'clock direction and the 6:00 o'clock direction are shown. In FIG. 14, the case wherein the display panel is substantially parallel to analog dial 32 is shown. For such a cell, a direction of clear vision within which a display in a twisted nematic liquid crystal can be visually distinguished from the remainder of the panel has been investigaed experimentally. It has been found that the direction of clear vision extends about 70° from an angle A (73) inclined 20° towards the 12:00 o'clock direction and an angle B (74) for about 50° towards a 6:00 o'clock direction, each angle measured from a normal direction 72 with respect to the panel. Thus, characters in the display can be visually distinguished when viewed as far away from normal as line of view 43*a* which is inclined at 50° from normal direction 72. When a watch having a cell disposed in the horizontal direction is worn, it is generally inclined from the 6:00 o'clock direction thereby permitting viewing within the direction of clear vision.

FIG. 15 illustrates the embodiment in accordance with the invention wherein the panel is inclined at an angle of 15° with respect to analog dial 32. Each angle A (73) and angle B (74) has the same values as the panel of FIG. 9 for the angle of clear vision with respect to normal direction 72. In this case, line of view 43*b*, wherein the watch is viewed substantially from above, falls within the angle of clear vision as indicated by angle A. Additionally, the inclined vision is also improved as the angle of clear vision extends to a line of view 43*c* closer to the horizontal than line of view 43*a* which was established when the display panel was placed in the horizontal as shown in FIG. 14. As a result of this, the viewability of a watch worn on a human wrist can be improved.

The display panel may be so inclined that the direction of clear vision is such that a panel can be viewed from a direction substantially above the watch as shown in FIG. 15. It will also be understood that the angle of inclination of the panel between about 20° to 30° with respect to the horizontal direction is clearly within the limits of inclination of the panel as determined above.

Referring now to FIG. 16, the extreme configuration wherein the panel is inclined in an angle of 45° is shown. In this case, if the angle of clear vision ranges between lines of sight 73 and 74, acceptable contrast results when the watch is worn on a human wrist. However, the characters in the display are not visually distinguishable when viewed along the line of view 43*b* substantially above the watch, because this line of view fails to fall within the range of the angle of clear vision as described above.

In order to maintain sufficient clarity and discrimination of the characters in the display, a problem arises. Specifically, the relative size of the characters to be read out at the angle of view compared to the actual characters is reduced to $1/\sqrt{2}$ in the case of an angle of inclination of 45°. Thus, correspondingly smaller characters have to be read. Based on this, there is a limit in the angle of inclination. In order to obtain clear vision, however, the orientation of the twisting direction of the liquid crystal material can be altered in order to shift the direction of clear vision to that substantially above the panel as described in connection with Japanese Patent Publication No. 53-6857, referred to above. However, altering the angle of clear vision impedes mass production of LC displays as this requires altering the twisting direction in order to obtain a different angle of clear vision for each panel dependent upon the inclination of the panel in a specific watch case. As a result of this, the panels cannot be inclined at any desired angle and a degree of freedom in design of the wristwatch is lost. In this respect, the angle of inclination in accordance with the invention has been established by preferred inclining of a conventional panel which is a significant advantage in production. Moreover, this generally insures clear vision at an inclination over the range of the normal angles of viewing. As has been described in detail in connection with the electrical connections between display panel 45 and circuit substrate 50, if the panel is inclined at a substantial angle, a specially designed connector 42 will be required. Under these conditions, the maximum angle of inclination between liquid crystal panel 45 from the 6:00 o'clock to 12:00 o'clock direction with respect to analog dial 32 is preferrably less than 30°.

The parameters dictating the minimum angle of inclination will now be explored. Assuming that display panel 45 of a man's wristwatch is large enough to extend to the boundary of the hour hand 31*c* of hand set 31 of analog display 33. In this case, analog display 33 is as small as possible. The length of both analog display 33 and digital display 45 measured along the line intersecting the 12:00 and 6:00 o'clock directions is about 25 to 30 mm. If analog diaplay 33 requires about 12 to 18 mm, about equal to the size of a dial in a standard size female wristwatch, the resulting difference allows a length of about 15 mm for digital display 45. Moreover, the sectional height of display panel 45 is assumed to between 1 to 1.5 mm as noted above in connection with the spacing of hand set 31 of analog display 33. In this case, a maximum inclination of panel 45 is determined by the following expression:

$$\sin^{-1}\frac{1 \text{ to } 1.5}{1.5} \approx 4 \text{ to } 6 \text{ degrees}$$

Based on the discussion in connection with maximum angle of inclination and the minimum angle of inclination, the preferred range of inclination of a liquid crystal display panel is between about 5 to 30 degrees. A most preferred intermediate range is between about 10 to 15 degrees. This is considered the most practical inclination based on the actual size of a wristwatch and the size of characters in the display panel for obtaining sufficient contrast and for making appropriate electrical connections between the electrodes and the circuit substrate. Since the panel of digital display 45 is inclined with respect to the plan in which each of the hands of hand set 31 of analog display 33 roatate, second hand 31*a* and minute hand 31*b* of analog display can be arranged so as to overlap a portion of display 45 when the display surface of watch case 61 is viewed above in plan view. In accordance with this construction, the rotational plan each of the hands of hand unit 31 can be made larger than analog display dial 32. In other words, the analog display utilizes a portion of the space above digital display 45 enabling construction of a small and thin watch or a larger analog display in a given space.

The ratio of the size of display panel 45 to the size of analog display panel 33 for the maximum and minimum angle of inclination will be explored. In the above discussions for both the maximum and minimum angles, the length of digital display panel 45 in the 12 to 6:00 o'clock direction of a man's wristwatch is about 1.5 mm. For the case of a maximum angle of inclination the ratio of the size of display angle 45 to analog display 33 can be as low as about 5%. This is the case because the size of the observable dial when viewed in the same direction as digital display 45 is generally about 25 to 30 mm. On the other hand, in the case of a minimum angle of inclination, if display panel 33 is at its maximum size of 15 mm, the length of digital display 45 in the 12:00 to 6:00 o'clock direction is about 50% of analog display 33. However, in this latter case inclination of the panel is reduced to the point where the effect of the inclined panel is minimum so that the ratio is actually about 30%.

Figure 11:
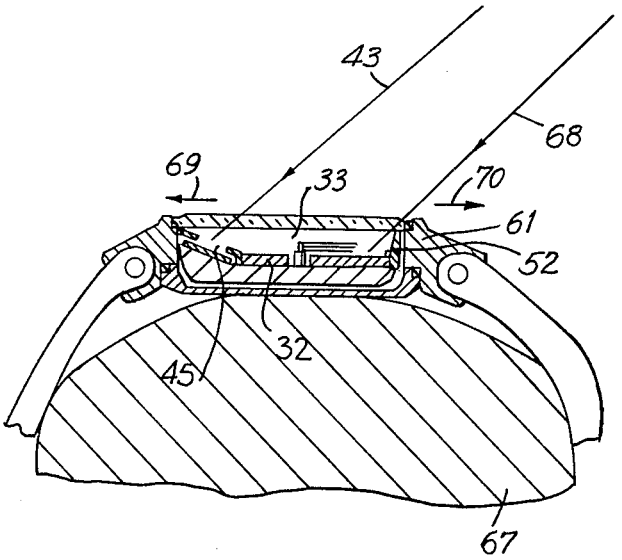
FIG. 11 is a cross-sectional view illustrating viewing a wristwatch constructed and arranged in accordance with the invention as depicted in FIGS. 7 and 8.

Turning now to FIG. 11, the actual viewing conditions when a wristwatch constructed and arranged in accordance with the invention is worn on a wrist is shown. The wristwatch includes analog display 33 and digital display 45 with the watch worn on a wrist 67. Digital display 45 is disposed in the 12:00 o'clock region 69 of analog dial 32 when view along the line of view 43. Analog display 33 constitutes a plane parallel to cover glass 60 as illustrated in cross-section in FIG. 7 and occupies the substantiatial planar surface of watch case 61. If digital display 45 is placed in the 6:00 o'clock region 70 of watch case 61, as illustrated in the conventional construction illustrated in FIG. 4, the wearer's line of view is oriented in a direction shown as 68. Line of view 68 cannot insure clear view when the watch is worn because a portion of the 6:00 o'clock region of analog dial 32 is shielded by the 6:00 o'clock region of watch case 61 and parting frame member 52. Thus, the construction in accordance with the invention wherein digital display panel 45 is positioned in the 12:00 o'clock region is clearly preferable. In addition, if the wearer alters the angle of view towards the region more directly over analog display 33 in order to avoid interference by watch case 61 the possibility arises that the digital display will not be clearly distinguishable due to total reflection of light at the electrodes which have not been energized. This phenomenon was discussed above in connection with FIG. 10. Further, by constructing the wristwatch in accordance with the invention wherein digital display 45 is positioned in the 12:00 o'clock region of analog dial 32, the viewer tends to view the entire analog display and the digital display thereby imparting true hybrid design to the wristwatch.

The advantages of a hybrid design wristwatch in accordance with the invention wherein the digital display is inclined with respect to the analog display are as follows.

1. When a watch constructed and arranged in accordance with the invention is worn on a wrist, analog dial 32 is generally inclined with respect to the line of view so that the 12:00 o'clock region is lower and the 6:00 o'clock region is raised. An analog display in this orientation can be easily distinguished, however, the characters in a digital display are more difficult to distinguish visually. According to the instant invention, a digital display having characters of reduced size when inclined at an angle between about 5° and 30° with respect to the analog display may easily be visually distinguished.

2. By positioning the digital display at an inclined angle in the space occupied by the hand set the digital display does not appear as if it is recessed within the analog display dial. In the construction of FIG. 2, digital display 5 is recessed within analog dial 32 which prevents easy viewing of characters and digital display 5 and complete illumination is prevented as light is shielded by dial 32. On the other hand, a construction in accordance with the invention prevents the digital display from being shielded by dial 32. The digital display does not become unobservable due to proper position for providing sufficient contrast. As a result of this construction, characters in digital display 45 can be reduced in size to the lowest limit. As a result, a hybrid-type watch having a dominant analog display can be provided. In addition, a multitude of designs can be utilized when varying analog display dial 32.

3. Unobservability due to total reflection at the transparent electrodes does not occur in the normal range of viewing the wristwatch by a wearer. As shown in FIG. 10, if liquid crystal display panel 45 is viewed in a direction 43*a* normal to the cell, electrode segments 39*b* and 40*a*, across which the minimum threshold voltage has been applied will be visually distinguishable from the remainder of the non-energized electrode. Generally, electrode such as 39*a* will appear black and the remaining electrodes will not be preceived as they are usually made of a thin film of tin oxide having a thickness of about 10 microns. However, when the display is viewed from a direction indicated at 55, a line of view 53, electrode segment 39*a* totally reflects the image of the light source 56. The remaining portion of the cell free of electrodes does not generate the reflection in the direction of view 54 so that even when an electrode segment, such as 39*a* in this case, is not energized, the resultant character display cannot be readily distinguished. This poor readability of the digital display increases when the size of the display panel is reduced. Thus, the construction in accordance with the invention enjoys the advantages that the line of view 43*a* as shown in FIG. 7, is generally normal to display panel 45 when the watch is being worn by a wearer. Thus, when digital display 45 is viewed in normal direction 43 incoming light corresponding to source 56 of FIG. 10 is shielded because the wearer's body will be located at the 6:00 o'clock side of the wristwatch so that a minimum of reflection occurs.

4. In the construction in accordance with the invention, digital display panel 45 is disposed within the region between the upper surface of watch dial 32 on the lower surface of cover glass 62. This permits a thin watch effectively utilizing the space necessary for positioning of hand unit 31 of analog display 33. Moreover, second hand 31*c* and minute hand 31*b* of analog display 33 can be accommodated in a region overlapping the 6:00 o'clock region of digital display 45 so as to utilize this space between cover glass 62 and watch dial 32 more effectively. This also permits enlarging the analog display without increasing the overall size of watch case 61.

5. The discontinuance appearance between the digital display and analog display of the prior art hybrid-type wristwatches is also avoided in accordance with the invention. This discontinuance appearance is especially clear in the prior art constructions such as illustrated in FIG. 4 wherein the digital display is formed on the watch band region of watch case 61. In contrast, the construction in accordance with the invention where a display surface may be provided with adjacent display openings or parting plate member 52 may be utilized to separate adjacent digital display 45 and analog display 33 providing a truly integrated fielding without interfering with the fine finishing of an analog display dial. Moreover, various types of parting plate members including different colors and materials can be freely selected thereby increasing the design capabilities of the hybrid-type wristwatch. Further, analog display 33 can be varied as are conventional analog watch displays so that the designer still enjoys the many degrees of freedom free from the constraints of the digital display.

6. The drive circuits for both analog display 33 and digital display 45 can be accommodated in the same movement. It is unnecessary to provide a special construction for providing a digital display as in the case of the construction illustrated in FIG. 4. Accordingly, after-sales service can be readily provided as is the case with conventional analog display watches. Moreover, the water-proof property of conventional analog display watches is not interfered with so that the advantages obtained by the hybrid-type display does not interfere with this important consideration.

7. When a liquid crystal display panel is utilized as the digital display in the hybrid-type construction in accordance with the invention, the direction of clear vision is only slightly shifted from that of a conventional liquid crystal panel. In this case, a conventional liquid crystal panel may be utilized without making it necessary to adopt special production techniques. Moreover, the electrical connection between the liquid crystal panel and the circuit substrate may be provided by utilizing connectors in accordance with the invention. Accordingly, as itemized, the invention provides a hybrid-type display wristwatch including both an analog and digital display wristwatch.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A hybrid display watch comprising:

a watch case having an upper display surface and an interior, said display surface having at least one display opening;

a transparent cover panel within said display opening;

watch movement means including at least timekeeping circuit means and a gear train and motor for driving an analog display, and driving circuit means for driving a digital display, said movement disposed within said interior;

analog display means disposed within said interior between said movement and said transparent cover panel in registration with said display opening, said analog display means including a substantially planar analog dial covering at least a portion of said movement and at least an hour hand and a minute hand, said hands driven by said gear train and motor; and liquid crystal digital display means within said interior between said movement means and said transparent cover panel in the space occupied by said hands, said digital display means driven by said driving circuit means in said movement means and disposed adjacent said analog display means in registration with said at least one display opening, said digital display means occupying a smaller surface area than that of said analog display and mounted to said watch movement means and disposed in a direction of 12 o'clock of said analog display, the face of the liquid crystal digital display means being inclined to the direction of six o'clock with respect to said dial so that one side of the liquid crystal digital display means is adjacent to the dial and the other side of the display means is adjacent to the under surface of the transparent cover panel and further, said digitsal display and said hands being disposed in the same region defined by the space between said cover panel and said analog dial.

2. The hybrid display watch of claim 1, wherein said analog display hands and said digital display means do not overlap in plan view.

3. The hybrid display watch of claim 1, wherein the display surface is formed with a first analog display opening and a second adjacent digital display opening, said analog display and digital display opening in registration with said analog and digital displays, respectively.

4. The hybrid display watch of claim 3, wherein said second digital display opening is adapted to keep from view the periphery of the liquid crystal display means.

5. The hybrid display watch of claim 1, wherein said liquid crystal display means includes two opposed transparent panels spaced apart from each other with transparent electrode means deposited on the interior surfaces of said panels for forming characters thereon and a material in the space between said panels adapted to have regions thereof rendered visually distinguishable from the remainder of said material when a predetermined voltage is selectively applied across the electrode means, an upper and a lower polarizer disposed on the outer surfaces of the panels.

6. The hybrid display watch of claim 5, wherein said liquid crystal display cell further includes a reflector disposed beneath the lower surface of the lower polarizer.

7. The hybrid display watch of claim 5, further including a parting frame member disposed between said displays and said transparent cover plate for keeping the peripheral regions of said displays from view, said parting frame member formed with a first analog display opening and a second smaller digital display opening, said openings in registration with said respective displays.

8. The hybrid display watch of claim 5, wherein said analog display includes an hour hand, a minute hand and a second hand, said minute and second hands extending over a portion of said liquid crystal display when viewed in plan view.

9. The hybrid display watch of claim 5, wherein said upper panel of said liquid crystal display extends beyond the opposed lower panel for providing an electrode terminal region and a resilient conductive member disposed between said terminal region and said movement for providing electrical connection to said electrode means on said panels.

10. The hybrid display watch of claim 9, wherein said liquid crystal display further includes an inclined support member havng an opening therethrough, said resilient conductive means disposed in said opening for providing the electrical connection to said electrode means.

11. The hybrid display watch of claim 8 wherein said digital display is inclined at an angle between about 5° and 30° with respect to said analog dial.

12. The hybrid display watch of claim 5 wherein said digital display is inclined at an angle between about 10° to 15° with respect to said analog dial.

13. The hybrid display watch of claim 1, wherein the watch case is formed with one display opening for receipt of the cover panel and includes a parting plate formed with a first analog display opening and a second digital display opening dimensioned to cooperate with the analog display means and digital display means, the parting plate disposed within the display opening in the watch case on the inside surface of the transparent cover panel.

* * * * *